US006834455B2

(12) United States Patent
Burigana

(10) Patent No.: US 6,834,455 B2
(45) Date of Patent: Dec. 28, 2004

(54) STOCK FOR FIREARMS

(75) Inventor: Lucio Burigana, Roveredo in Piano (IT)

(73) Assignee: Benelli Armi S.p.A., Urbino (IT)

( * ) Notice: Subject to any disclaimer, the term of this patent is extended or adjusted under 35 U.S.C. 154(b) by 0 days.

(21) Appl. No.: 10/395,680

(22) Filed: Mar. 24, 2003

(65) Prior Publication Data

US 2003/0182837 A1 Oct. 2, 2003

(30) Foreign Application Priority Data

Mar. 27, 2002 (IT) ..... MI2002A0633

(51) Int. Cl.[7] ..... F41C 23/00
(52) U.S. Cl. ..... 42/74; 42/71.01; 89/1.42
(58) Field of Search ..... 42/74, 71.01; 89/1.42

(56) References Cited

U.S. PATENT DOCUMENTS

| | | | | | |
|---|---|---|---|---|---|
| 319,613 | A | * | 6/1885 | Onderdonk | 42/74 |
| 2,791,155 | A | | 5/1957 | Thiel | |
| 3,248,818 | A | * | 5/1966 | Baldock | 42/74 |
| 3,267,602 | A | | 8/1966 | Miller | |
| 4,551,937 | A | | 11/1985 | Seehase | |
| 4,998,367 | A | | 3/1991 | Leibowitz | |

* cited by examiner

*Primary Examiner*—Michael J. Carone
*Assistant Examiner*—M. Thomson
(74) *Attorney, Agent, or Firm*—R. Neil Sudol; Henry D. Coleman; William J. Sapone

(57) ABSTRACT

A stock for firearms comprises slots or cutouts provided in the body of the stock and filled with material adapted to absorb energy, in order to reduce recoil and nozzle rise, upon firing.

5 Claims, 5 Drawing Sheets

STOCK FOR FIREARMS

BACKGROUND OF THE INVENTION

1. Field of the Invention

The present invention relates to a stock for firearms such as rifles and shotguns.

2. Description of the Prior Art

The stock of a rifle or shotgun sets the distance between the shoulder of the shooter and the breech, adjusts the center of gravity of the firearm, and distributes the pressure generated by the kinetic energy of recoil over a larger surface, so as to reduce its unit value and transmit it to the shooter's shoulder.

Generally, the cross-section of the body of the stock is oval, with a vertical major axis and the point directed downward. The stock ends with a face that is slightly curved and perpendicular to the axis of the barrel.

The stock angle brings the line of sight close to the eyelevel and determines the cushioning action against the recoil force.

As the stock angle increases, the component of the recoil force that acts on the shoulder decreases, while the component that is normal to the axis of the barrel increases; such normal component causes the nozzle of the firearm to rise or jump when firing. Such nozzle rise is contrasted by the hand of the shooter.

Several contrivances have been proposed for reducing the dynamic load on the shoulder caused by the recoil of the firearm, or for improving the ballistic features of the weapon, including accessories to be applied to the stock and internal mechanisms of various kinds.

Systems based on mechanisms contained within the stock have the drawback of being structurally complicated and therefore expensive.

Accessories to be applied to the stock can be cheaper but do not offer optimum functional features.

U.S. Pat. Nos. 4,551,937 and 3,267,602 disclose such an accessory constituted by a pad, for use on the end of the stock of a rifle or shotgun, having a number of slots.

SUMMARY OF THE INVENTION

The aim of the present invention is to provide a stock for firearms, particularly for rifles, that overcomes the drawbacks of the cited prior art.

An object of the invention is to provide a stock for firearms that is capable of reducing the dynamic load on the shoulder produced by the recoil of the firearm.

A further object of the invention is to provide a stock for firearms, particularly for rifles, capable of reducing the muzzle rise upon firing, consequently increasing target acquisition speed for the successive shots.

A further object is to provide a stock for firearms that can be manufactured at low cost and without using complicated mechanisms.

This aim and these and other objects that will become better apparent hereinafter are achieved by a stock for firearms, comprising slots or cutouts provided in the body of the stock and filled with material adapted to absorb energy.

BRIEF DESCRIPTION OF THE DRAWINGS

Further characteristics and advantages of the invention will become better apparent from the description of preferred but not exclusive embodiments thereof, illustrated by way of non-limitative example in the accompanying drawings, wherein.

DESCRIPTION OF THE PREFERRED EMBODIMENTS OF THE INVENTION

Figure 1:
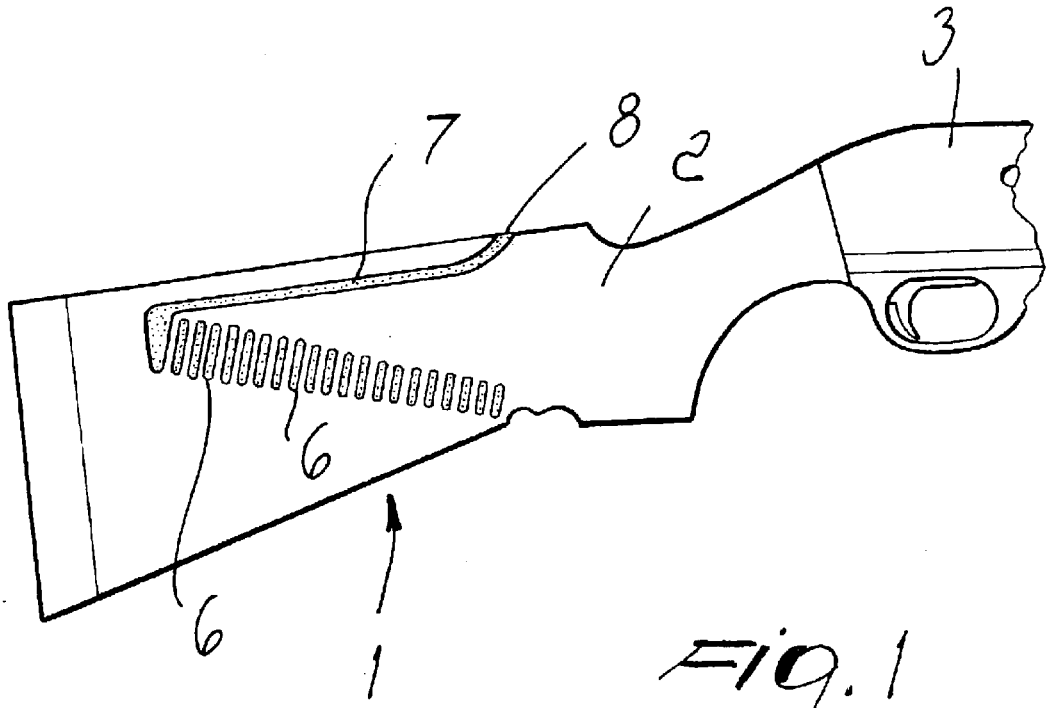
FIG. 1 is a side view of a stock for firearms according to the invention, shown in an inactive condition.
Figure 2:
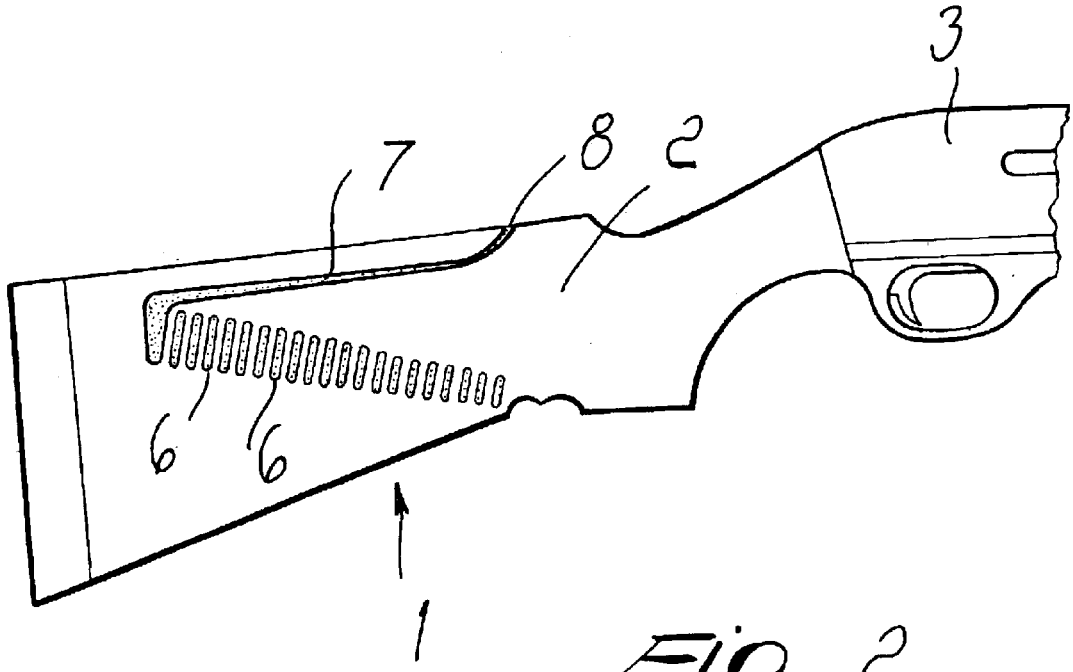
FIG. 2 is a view, similar to FIG. 1, in which the stock is instead shown in a deformed condition immediately after firing.
Figure 3:
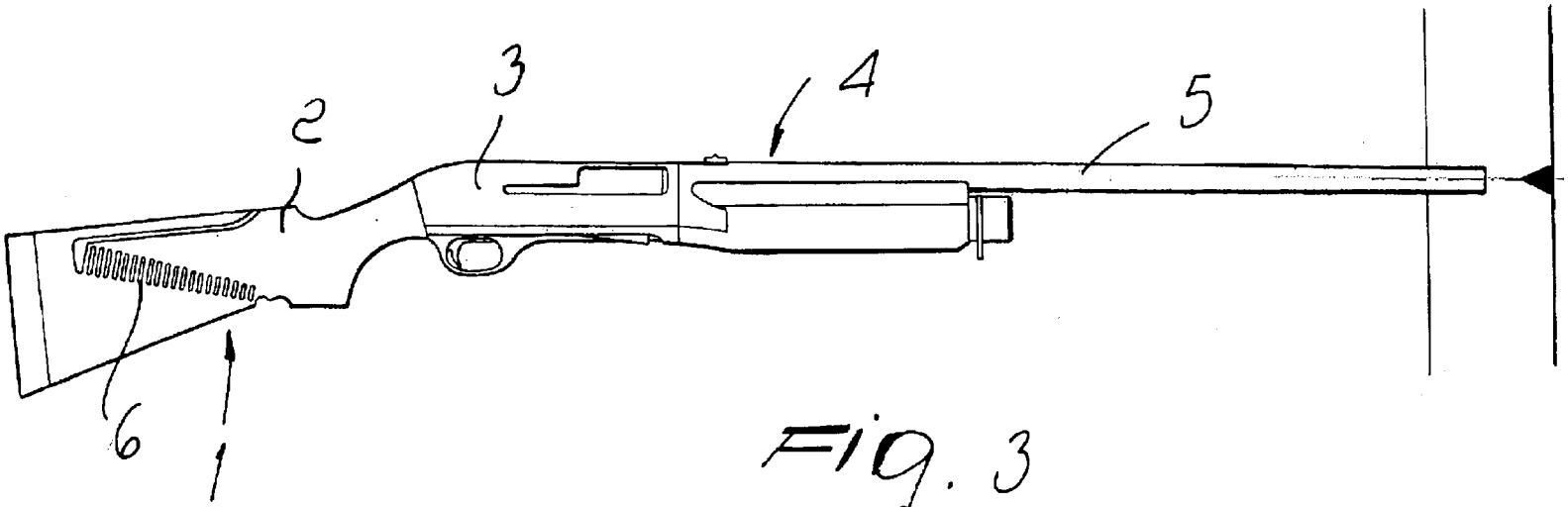
FIG. 3 is a side view of a firearm provided with the stock according to the invention, shown in an inactive condition.

With reference to the above cited figures, the stock for firearms according to the invention, generally designated by the reference numeral 1, comprises a body 2 associated with a housing 3 of a firearm 4, for example a shotgun, which is provided with a barrel 5.

According to the invention, slots 6 are produced in the body 2 of the stock by milling or, more preferably, during molding of the stock, and are filled with material adapted to absorb energy, typically an elastomer or another material having similar characteristics.

In the embodiments of the illustrated examples, the cutouts or slots are shaped like inclined parallel slots that cross the stock body diagonally along a general direction from a lower front position to an upper rear position.

The stock also comprises a substantially horizontal cutout 7, which runs longitudinally along the stock body and opens externally in an upper front position 8. By varying the number of cutouts, their geometry and their position with respect to the axis of the barrel, one obtains different results in terms of absorption of recoil energy and muzzle rise.

FIGS. 5 to 10 illustrate six different embodiments of the stock according to the invention, designated respectively by the reference numerals 101, 201, 301, 401, 501 and 601, which illustrate some of the possible configurations in terms of shape, arrangement, number and dimensions of the cutouts.

Figure 10:
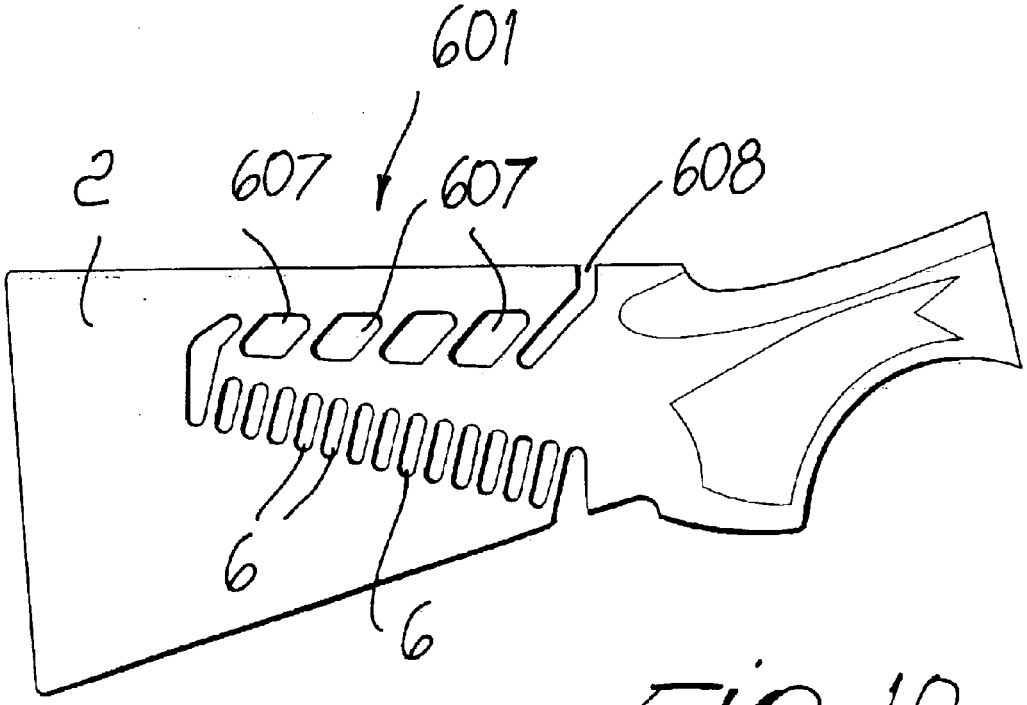

FIG. 10, for example, illustrates a stock 601 in which the upper horizontal cutout is constituted by a plurality of slots 607, which run along a longitudinal direction and end with a cutout 608 that opens outward.

The stock according to the invention allows first of all to reduce the dynamic load on the shoulder of the shooter produced by the recoil of the firearm. The reduction in the dynamic load caused by recoil is particularly advantageous when using high-pressure and high-weight cartridges.

A further advantage of the present invention relates to the ballistic behavior of the firearm: the particular structure of the stock in fact reduces muzzle rise upon firing, with consequent speed of target acquisition for shots following the first one.

Figure 4:
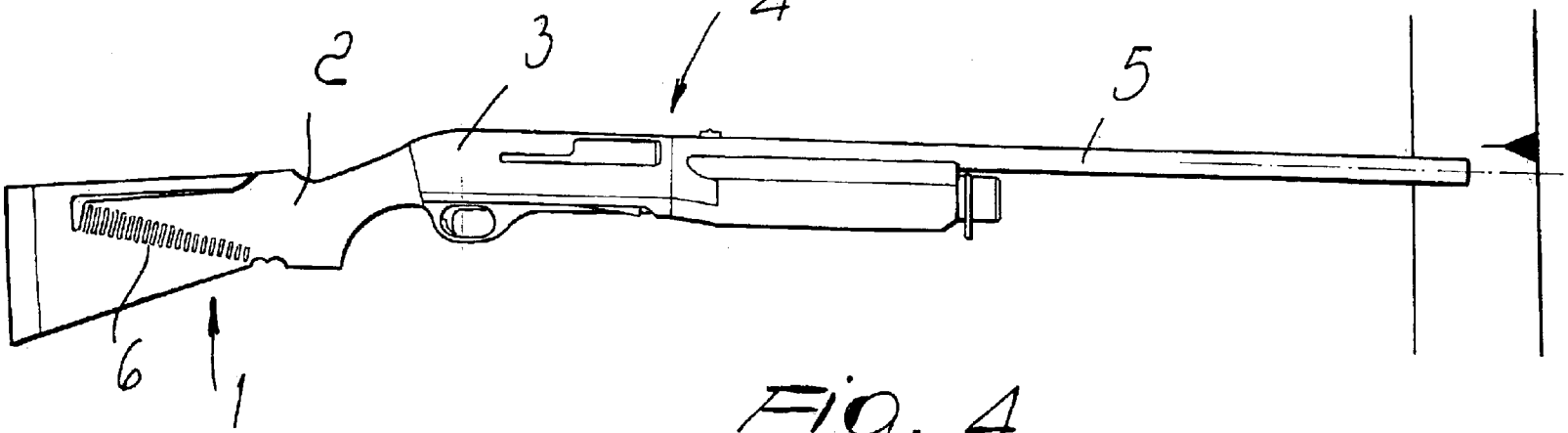
FIG. 4 is a view, similar to FIG. 3, in which the firearm provided with the stock according to the invention is instead in a deformed condition immediately after firing.
Figure 5:
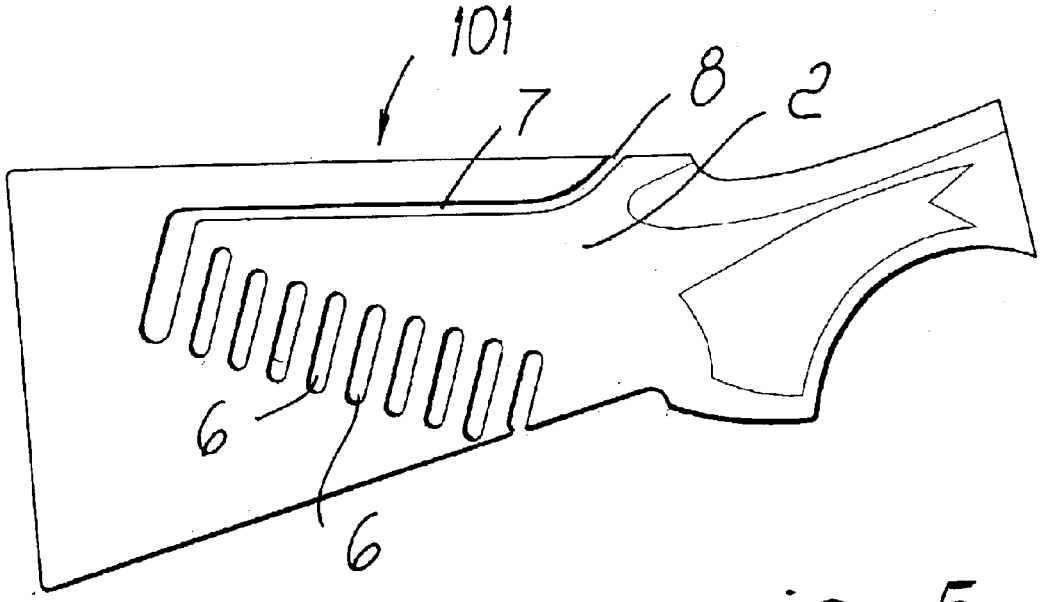
FIGS. 5 to 10 are side views of six of the possible embodiments of the stock according to the invention.
Figure 6:
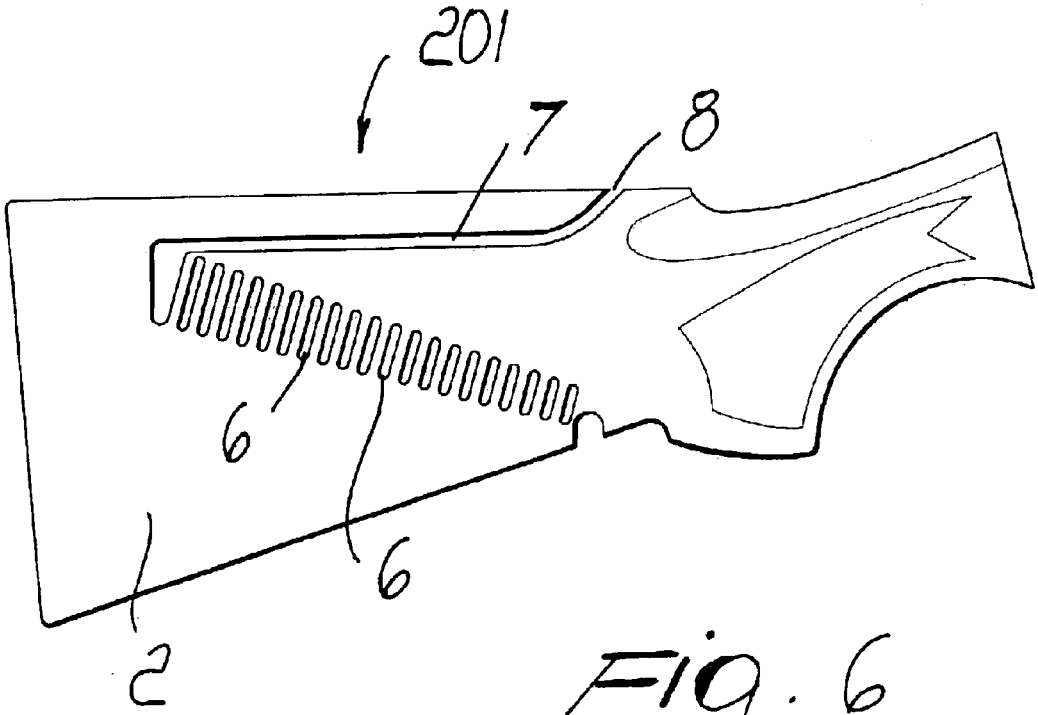
Figure 7:
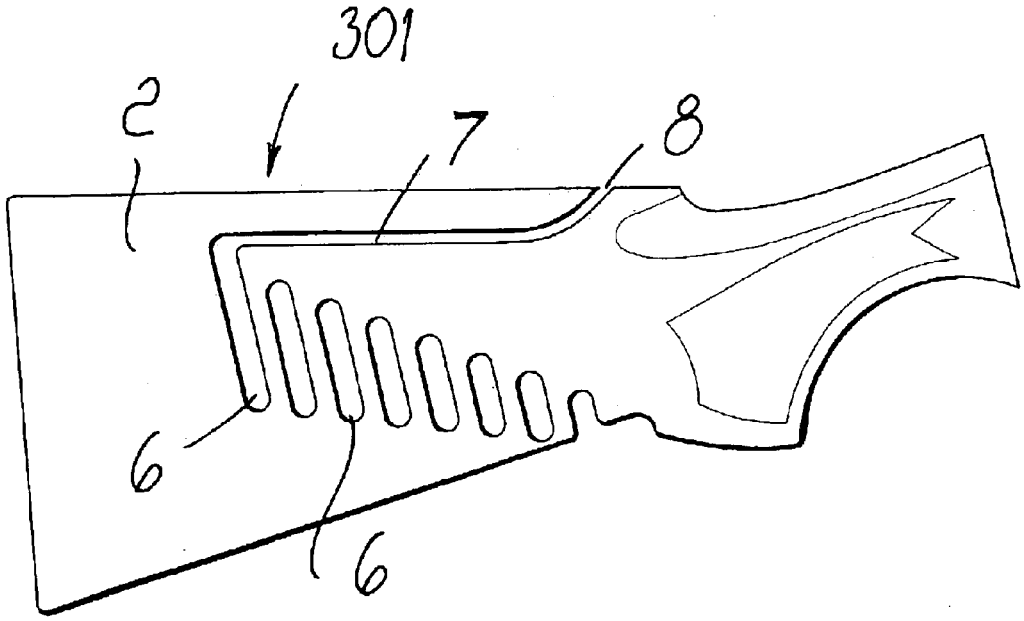
Figure 8:
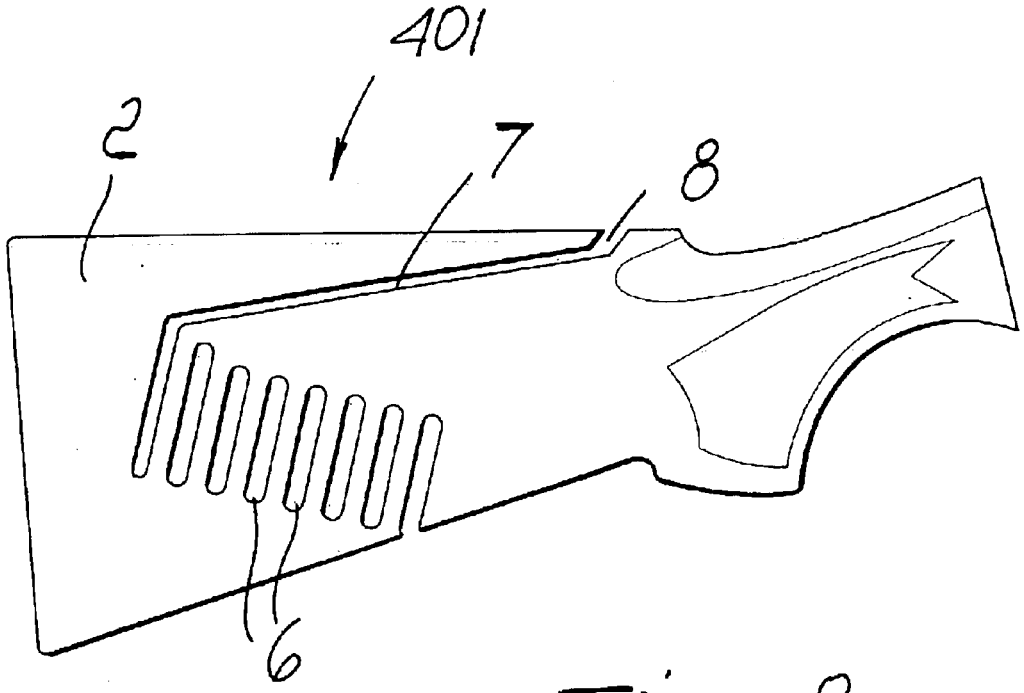
Figure 9:
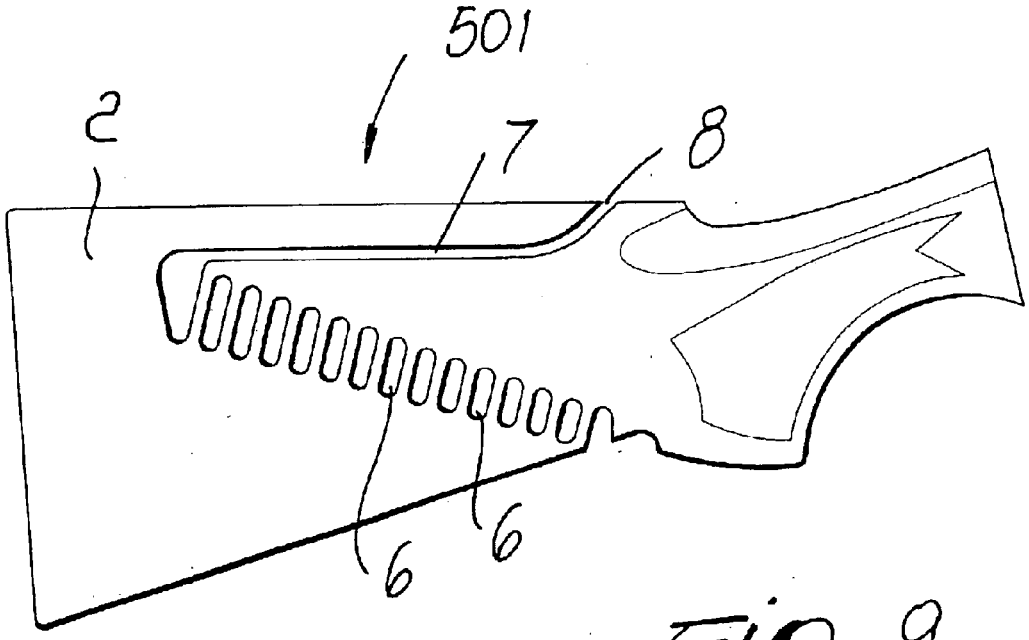

This reduction in muzzle rise is due to the fact that the deformation of the stock upon firing creates a component of the recoil force in a downward vertical direction that lowers the barrel, as shown schematically in FIG. 4, compensating for the "natural" muzzle rise, i.e., for the upward component of the force generated upon firing.

In practice it has been observed that the invention achieves the intended aim and objects, a stock having been provided which is capable of improving the comfort of the shooter and the ballistic behavior of the firearm with a considerable reduction in production costs with respect to conventional systems using complicated mechanisms located inside the stock itself.

The stock according to the invention is also far more effective than the various hitherto known accessory devices, such as buttstock pads provided with particular structures suitable to absorb the recoil force.

The stock according to the invention is susceptible of numerous modifications and variations, within the scope of the appended claims. All the details may be replaced with technically equivalent elements.

The materials used, as well as the dimensions, may be any according to requirements and to the state of the art.

What is claimed is:

1. A stock for firearms, comprising slots or cutouts extending substantially along an entire length of the stock and filled with a material adapted to absorb energy, wherein said slots or cutouts are formed as parallel rectilinear slots which cross the stock diagonally in a generally diagonal direction from lower front position to an upper rear position of the stock, further comprising a substantially horizontal cutout that runs longitudinally along the stock body and is open externally in an upper front position.

2. The stock according to claim 1, wherein said slots or cutouts are formed as parallel inclined slots.

3. The stock according to claim 1, further comprising an upper horizontal cutout member constituted by a plurality of slots that run in a longitudinal direction and end with a cutout that opens onto the outside.

4. A stock for firearms, comprising slots or cutouts extending substantially along an entire length of the stock and filled with a material adapted to absorb energy, wherein said slots or cutouts are formed as parallel rectilinear slots which cross the stock diagonally in a generally diagonal direction from a lower front position to an upper rear position of the stock, and wherein said material adapted to absorb energy is constituted by an elastomer.

5. A stock for firearms, comprising slots or cutouts extending substantially along an entire length of the stock and filled with a material adapted to absorb energy, wherein said slots or cutouts are formed as parallel rectilinear slots which cross the stock diagonally in a generally diagonal direction from a lower front position to an upper rear position of the stock, and wherein said slots or cutouts are formed during a molding of the stock.

* * * * *